US007683245B2

(12) United States Patent
Judd

(10) Patent No.: US 7,683,245 B2
(45) Date of Patent: Mar. 23, 2010

(54) PICK FOR STRINGED MUSICAL INSTRUMENTS

(75) Inventor: Brian Judd, Campbell, CA (US)

(73) Assignee: Probe Specialists, Inc., Morgan Hill, CA (US)

( * ) Notice: Subject to any disclaimer, the term of this patent is extended or adjusted under 35 U.S.C. 154(b) by 84 days.

(21) Appl. No.: 10/996,884

(22) Filed: Nov. 24, 2004

(65) Prior Publication Data

US 2005/0109189 A1 May 26, 2005

Related U.S. Application Data

(60) Provisional application No. 60/525,445, filed on Nov. 26, 2003.

(51) Int. Cl.
*G10D 3/16* (2006.01)

(52) U.S. Cl. ..... 84/322; 84/320

(58) Field of Classification Search ..... 84/322, 84/320, 321; D17/20, 99
See application file for complete search history.

(56) References Cited

U.S. PATENT DOCUMENTS

| | | | | |
|---|---|---|---|---|
| 2,170,179 | A * | 8/1939 | Wolcott | 84/322 |
| 4,993,302 | A * | 2/1991 | Jonathan | 84/322 |
| 5,859,377 | A * | 1/1999 | Mackey et al. | 84/322 |
| 6,346,662 | B1 * | 2/2002 | Sielaff | 84/322 |
| 2002/0108483 | A1 * | 8/2002 | Smith | 84/322 |
| 2004/0118265 | A1 * | 6/2004 | Katz | 84/322 |

* cited by examiner

*Primary Examiner*—Jianchun Qin
(74) *Attorney, Agent, or Firm*—Michael A. Glenn; Glenn Patent Group

(57) ABSTRACT

A pick for strumming stringed musical instruments is provided, wherein some embodiments the strumming pick are fabricated from a compliant material. In other embodiments of the present invention, an ergonomically contoured depression is formed into the front side of the pick and means corresponding ergonomically contoured protrusion is formed upon the backside of the pick. Yet other embodiments combine the foregoing compliant aspect and the ergonomic aspects.

9 Claims, 4 Drawing Sheets

PICK FOR STRINGED MUSICAL INSTRUMENTS

CROSS-REFERENCE TO RELATED APPLICATIONS

The present Utility patent application claims priority to the provisional application for patent having the application number of 60/525,445 and was filed on Nov. 26, 2003.

FIELD OF THE INVENTION

The present invention relates generally to picks for stringed musical instruments. More particularly, the invention relates to stringed musical instrument picks having ergonomic construction features.

BACKGROUND OF THE INVENTION

It has long been a problem for stringed musical instruments (e.g., guitar) players to hold on to and get a firm grip on the string pick (pick) that they use to pluck the string. Musicians of stringed instruments such as, for example, guitars, banjos, ukuleles, bass, and harps, commonly use picks. A common problem for conventional picks is for them to spin out from the grip of the fingers during play. However, typically, there is a significant reluctance for musicians to learn to use new designs that may help over come shortcomings of traditional picks.

Traditional picks are usually flat, made of relatively stiff materials, and may be die cut or injection molded to achieve a desired shape. The stiffness of traditional picks results in a very different, often less pleasing, sound than when fingers are used to pluck the instrument's strings. Moreover, traditional picks often spin in the musician's hand while strumming and picking at least because they have a flat, smooth surface that is relatively hard to grip firmly. When gripping along the length of the pick there is a torque created that tends to leverage the pick free to spin it in the musician's fingers.

Some conventional picks have equal depressions formed on both sides of the pick; however, musicians often find gripping one side of such picks uncomfortable. Other conventional picks that attempt to improve picking ease and control have a curved, wave like shape with generally parallel top and bottom surfaces, whereby only a string engaging lengthwise end is flat (usually about one quarter inch at the end is flat) and the side edges are not flat. Although, such wave shaped picks are helpful in some applications, they suffer from many limitations by virtue of not being generally flat. For example, wave shaped picks are more bulky and do not fit in conventional pick holders, which musicians often use. Moreover, a wave shaped pick's flexibility is significantly different from predominantly flat designs of the same thickness. This flexibility behavioral difference is further unpredictably complicated when the thickness of the pick is changed. Many musicians will learn how to play a conventional pick of a certain thickness, and find it exceedingly difficult to quickly learn how to play a wave shaped pick. Additionally, musicians often find such picks very uncomfortable to play, especially at arbitrary gripping angles.

In view of the foregoing, there is a need for improved techniques for constructing stringed musical instrument picks. For example, it would be desirable for an improved pick design that is adequately similar to traditional designs to minimize the need for musicians to relearn their pick training. It would be further desirable to allow the musician to comfortably grip the pick from many angles and achieve a finger-like strumming sound. Moreover, it would be helpful if as the thickness of the pick changed, these improvements are not lost or degraded.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
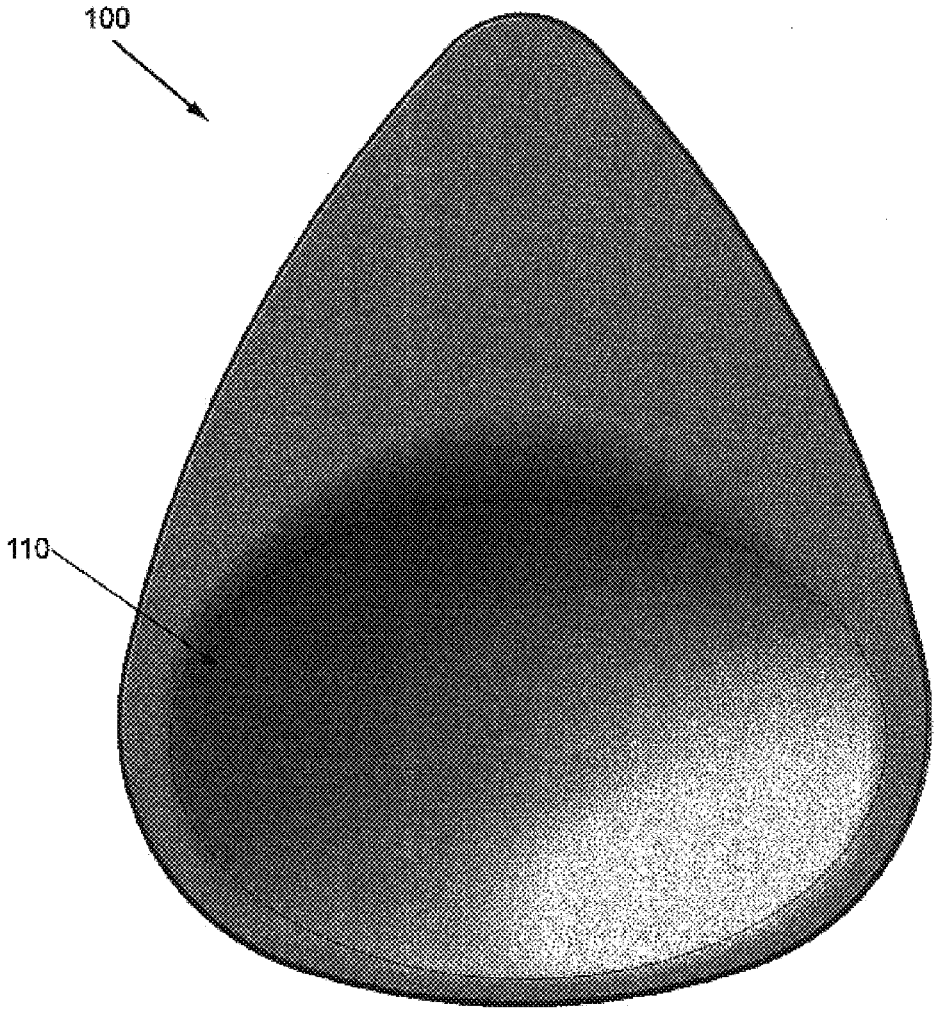
FIG. 1 illustrates by way of example the front side of a teardrop shaped pick configured according to a uniform thickness embodiment of the present invention, wherein a thumb tip conforming depression is shown being substantially within the finely dashed ellipse, which is included for clarity.

Unless otherwise indicated illustrations in the figures are not necessarily drawn to scale.

SUMMARY OF THE INVENTION

To achieve the forgoing and other objects and in accordance with the purpose of the invention, a variety of techniques are described to achieve a pick for strumming stringed musical instruments.

A pick for strumming stringed musical instruments is provided, wherein some embodiments the strumming pick are fabricated from a compliant material, including but not limited to thermoplastic elastomers and common rubber. In other embodiments of the present invention, an ergonomically contoured depression is formed into the front side of the pick and means corresponding ergonomically contoured protrusion is formed upon the backside of the pick. Yet other embodiments combine the foregoing compliant aspect and the ergonomic aspects.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

In one embodiment of the present invention, an oblong contoured depression suitable to comfortably mate with a thumb and/or finger is formed into a front surface of an otherwise conventional pick. For example, the oblong contoured depression may be shaped to best fit and locate along the edge of the thumb and finger. In forming the contour depression on the front side of the pick, there is a corresponding bulge formed on a backside. In a preferred embodiment, the contoured depression is formed to be slightly oblong to match the shape of a thumb, whereby musicians will typically hold the present pick at a perpendicular or 45 degree angle to the thumb with respect to the length of the pick, with the index finger simultaneously gripping the backside bulge of the present pick. However, some musicians may instead find it desirable to grip embodiments of the present invention in a multiplicity of alternative and suitable ways. For example, embodiments of the present invention may also be gripped in a reverse position than that described above wherein the thumb, instead, holds the backside bulge and the index finger is placed in the contoured depression.

In a uniform thickness embodiment of the present invention, the three dimensional shape of the backside bulge exactly correspond to the front side contoured depression and the thickness between the backside bulge and the front side contoured depression ("contour thickness") is substantially the same as the overall thickness of the gripping end of the pick outside of the depressed region, thereby substantially maintaining the same thickness properties of a traditional pick of the same overall shape.

Figure 2:
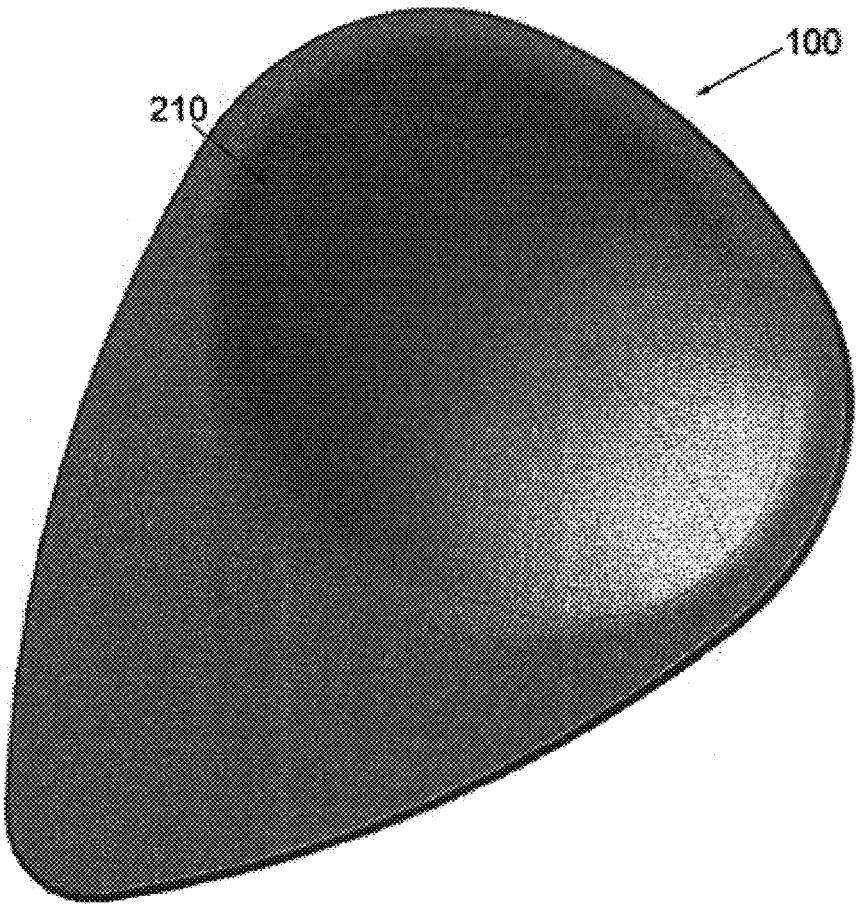
FIG. 2 illustrates by way of example the back side the pick shown in FIG. 1, wherein a bulge corresponding to the depression is shown being substantially within the finely dashed ellipse and bulges outward along the coarsely dashed lines, which are included for clarity.
Figure 3:
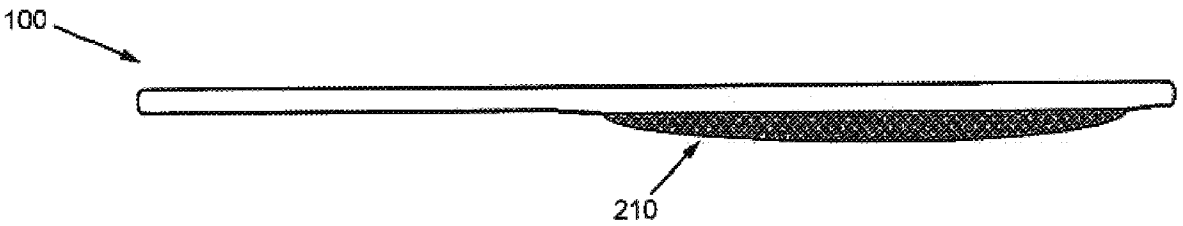
FIG. 3 illustrates by way of example a side view of the pick shown in FIGS. 1 and 2, wherein the bulge is shown bulging from the bottom of the pick.

FIG. 1 illustrates by way of example the front side of a teardrop shaped pick 100 configured according to the uniform thickness embodiment of the present invention, wherein a thumb tip conforming, oblong contoured depression 110 is shown being substantially within the finely dashed ellipse, which is included for clarity. FIG. 2 illustrates by way of example the back side the pick shown in FIG. 1, wherein a bulge 210 corresponding to the depression is shown being substantially within the finely dashed ellipse and bulges outward along the coarsely dashed lines, which are included for clarity. FIG. 3 illustrates by way of example a side view of the pick shown in FIGS. 1 and 2, wherein the bulge is shown bulging from the bottom of the pick In one aspect of the uniform thickness embodiment, a corresponding, and often desirable, uniform flexibility of the pick is provided to the user. Those skilled in the art will appreciate that variations in pick thickness tends to substantially change the properties of the pick, making the pick more difficult to use in some cases. By way of example, and not limitation, when gripping uniform thickness embodiments of the present invention at different angles or gripping locations, a similar flexibility may be experienced.

In some applications, embodiments having an overall flat shape are required, for example, to grip the pick from an arbitrary playing angle, whereby the outer edges of the pick contoured according to the present invention are kept relatively flat and substantially inline with the central plane of the pick. Hence, some embodiments of the present invention are designed to have edges of the pick that are relatively flat such that the contoured depression or bulge do not extend into the outer edge of the pick to maintain consistent flat edge along the perimeter of the pick, thereby keeping the edges of the pick in the central plane of the pick. This is helpful, for example, to accommodate using an arbitrary edge of the pick to play with. Those accustomed to using traditional picks, which are essentially flat, often desire such flat edge embodiments of the present invention.

Alternate embodiments of the present invention may vary the contour thickness according to the needs of the particular application. Moreover, embodiments of the present invention may configure the three dimensional shape of the backside bulge to be different than that of the front side contoured depression. Similarly, those skilled in the art will recognize a multiplicity of alternate and useful shapes of the backside bulge and/or the contoured depression according to requirements of the particular application. By enabling the degrees of freedom to fully adjust as needed the contour depression and bulge shapes, and the contour thickness, a wide range of high performance and ergonomic pick designs may be achieve in accordance with the principles of the present invention.

One aspect of contoured depression 110 is that it provides an increased contact surface area the musicians finger or thumb and pick 100, thereby providing increased grip and location control. By way of example, and not limitation, when a subtle contoured depression in the grip area of the pick is formed while maintaining a uniform contour thickness it is possible to double the grip contact area and virtually eliminate the musicians losing control of the pick, or spin. Another aspect of the present contoured depression and bulge is to provide a more natural and comfortable feel to the musician and thereby help reduce grip fatigue, thereby enabling longer playing sessions. In some cases, fatigued is reduced at least because less energy required to hold the present pick as the contoured depression of the present invention allows for more contact area at a given finger pressure between a players fingers and the pick as compared to conventional flat pick gripping surfaces.

Yet another aspect of the present contoured depression and bulge is that they independently or in unison facilitate for the musician the rapid (re)location of the correct gripping position of the pick (e.g., along the lengthwise end of ones thumb). This locating aspect of the present invention provides texture feedback to the user so that he or she may more quickly and accurately relocate their preferred gripping of the pick. This is especially helpful to relocate a previous gripping position if the pick somehow does slip from the finger. Moreover, the backside bulge allows the musician's index finger to grip around the bulge to some degree thereby further provide an improved and more natural grip of the pick that further helps prevent spinning and slippage, thereby improving overall control of the pick for more accurate play.

It should be appreciated that in uniform thickness embodiments of the present invention, which maintain substantially parallel front and back surfaces, a pick adapted according to the present invention can be made to any practical thickness while maintaining the performance and comfort aspects thereof. Many musicians accustom to playing a conventional pick of a certain thickness may tend to more quickly and more naturally learn how to how to play uniform thickness embodiments of the present invention.

Pick embodiments according to the present invention may be constructed in any known way as will be apparent by those skilled in the art, by way of example, and not limitation, suitable fabrication techniques include injection molding with commonly used pick materials or they bay be compression formed and cut. Embodiments of the present invention may be constructed of relatively stiff or relatively flexible materials. Known materials that achieve a relatively stiff pick include polycarbonates, acytel (e.g., by Duron™), or nylon.

Figure 4:
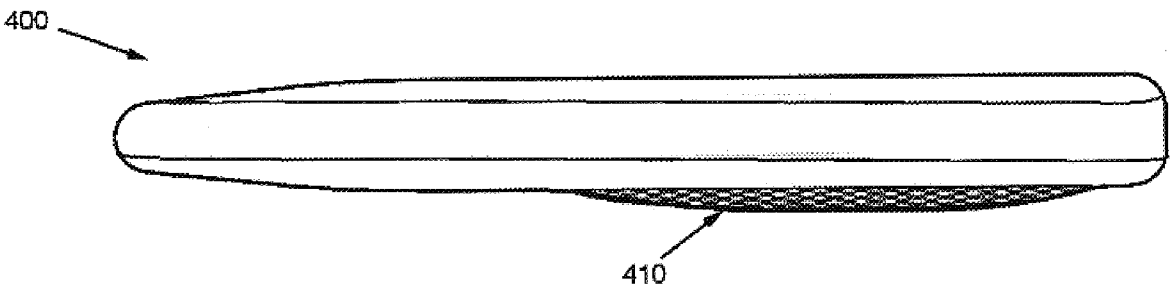
FIG. 4 illustrates by way of example a side view of a pick in accordance with a compliant embodiment of the present invention, wherein the bulge is shown bulging from the bottom of the pick.

A compliant embodiment of the present invention will now be described. FIG. 4 illustrates by way of example a side view of a pick 400 in accordance with a compliant embodiment of the present invention, wherein a bulge 410 that corresponds to the depression on the front side (not shown) is shown bulging from the bottom of the pick. The compliant embodiment is made of relatively flexible (not stiff), compliant materials including, but not limited to, thermoplastic elastomers (e.g. plastic moldable rubbers such as Santoprene) and common rubber. The compliant embodiment may be formed into a conventional shape (i.e., not including the foregoing contouring embodiments) or it may be shaped to include the foregoing contouring embodiments. The compliant embodiment of the present invention has a multiplicity of attendant aspects that provide additional utility to many musicians. By way of example, it is generally significantly more difficult for a musician to learn how to strum using their fingers instead of a pick. By using the foregoing compliant materials the attack when plucking an instrument's string is significantly muted thereby simulating a low attack fingerpick playing style. The degree of attack muting may be controlled by properly selecting the proper durometer or stiffness of the foregoing described compliant material used. Accordingly, the "pick noise" from impacting the strings is substantially reduced, if not eliminated and the resulting sound is generally warm and clean. Hence, musicians who are not trained in the finger picking style can approximate the sound accomplished by the finger picking style without any significant additional training. Moreover, in another aspect of the compliant embodiment, it is generally easier for a beginner to master the art of pick strumming in that the present compliant embodiment is more forgiving with regard to accuracy and foregoing compliant materials generally have high surface gripping properties that tend to easily grab the strings for a good pluck. Moreover, with the tapered shape shown in the Figures, sufficient rigidity is achieved given the foregoing compliant materials are inherently soft and flexible.

Figure 5:
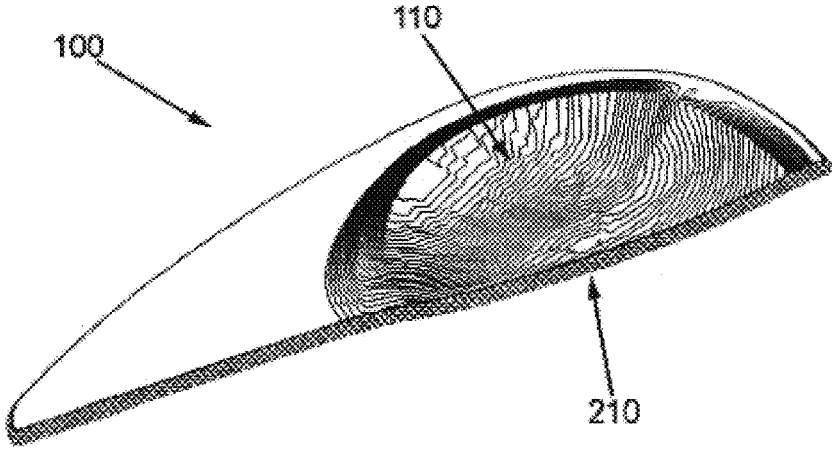
FIG. 5 illustrates by way of example a crossectional side view of the pick shown in FIG. 1, wherein the contoured depression and the corresponding backside bulge are simultaneously visible.

FIG. 5 illustrates by way of example a crossectional side view of the pick shown in FIG. 1, wherein contoured depression 110 and corresponding backside bulge 210 are simultaneously visible.

The compliant embodiment of the present invention may be constructed according to known methods including but not limited to, injection molding and thermoforming.

Alternative embodiments of the present invention may include a raised texture on contact surface(s) of the pick to further enhance the feel and grip of the pick by the musician (e.g., a raised hatch patter). Moreover, embodiments of the present invention may be formed in a multiplicity of suitable shapes depending on the needs of the particular application. Some common suitable shapes include, but are not limited to, triangle, tear drop, and Jazz style. Those skilled in the art will recognize how to adapt any suitable conventional pick to incorporate the teachings of the present invention. Embodiments of the present picks may be constructed to have any suitable thickness depending on the needs of the particular application.

Having fully described at least one embodiment of the present invention, other equivalent or alternative methods of providing a pick for strumming stringed musical instruments according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A contoured pick for strumming stringed musical instruments, the pick comprising:

a first side of the pick forming an ergonomically contoured substantially elliptical depression for a section of the pick that receives a user's first finger in a contact area;

a second side of the pick forming an ergonomically contoured substantially elliptical protrusion for a section of the pick that receives a user's second finger in a contact area;

a section of the first side of the pick that is outside the contact area forming a substantially flat surface; and a section of the second side of the nick that is outside the contact area forming a substantially flat surface.

2. The contoured pick of claim 1, wherein the pick is constructed of stiff material.

3. The contoured pick of claim 2, wherein the stiff pick material is selected from the group consisting of polycarbonates, acetyl, and nylon.

4. The contoured pick of claim 1, wherein the pick is constructed of flexible material.

5. The contoured pick of claim 1, wherein the dimensions of the protrusion correspond to the dimensions of the depression, thereby maintaining a substantially uniform thickness.

6. A flexible pick for strumming stringed musical instruments, the pick comprising:

a pick fabricated from a flexible material;

a first side of the pick forming an ergonomically contoured substantially elliptical depression for a section of the pick that receives a user's first finger in a contact area;

a second side of the pick forming an ergonomically contoured substantially elliptical protrusion for a section of the pick that receives a user's second finger in a contact area;

wherein the dimensions of the protrusion correspond to the dimensions of the depression, thereby maintaining a substantially uniform thickness;

a section of the first side of the pick that is outside the contact area forming a substantially flat surface; and a section of the second side of the nick that is outside the contact area forming a substantially flat surface.

7. The flexible pick of claim 6, wherein the material is selected from the group consisting of thermoplastic elastomers and common rubber.

8. The flexible pick of claim 6, wherein the dimensions of the protrusion correspond to the dimensions of the depression, thereby maintaining a substantially uniform thickness.

9. A contoured pick for strumming stringed musical instruments, the pick comprising:

a first side of the pick forming an ergonomically contoured substantially elliptical depression for receiving a user's finger in a contact area, the contact area comprising a raised texture;

a second side of the pick forming an ergonomically contoured substantially elliptical protrusion for a section of the pick that receives a user's second finger in the contact area, the contact area comprising a raised texture;

the first side of the pick that is outside the contact area forming a substantially flat surface; and the second side of the pick that is outside the area that forming a substantially flat surface.

* * * * *